United States Patent [19]

Wilhelm

[11] 4,136,412

[45] Jan. 30, 1979

[54] AIR MATTRESS

[75] Inventor: Manfred Wilhelm, Siegen, Germany

[73] Assignee: Josef Meire, Liechtenstein

[21] Appl. No.: 856,122

[22] Filed: Nov. 30, 1977

[30] Foreign Application Priority Data

Aug. 9, 1977 [DE] Fed. Rep. of Germany ..... 2740412

[51] Int. Cl.[2] ..... A47G 9/08; A47C 27/08

[52] U.S. Cl. ..... 5/344; 5/343; 5/365

[58] Field of Search ..... 5/191, 338, 343, 344, 5/365, 349, 350

[56] References Cited

U.S. PATENT DOCUMENTS

| | | | |
|---|---|---|---|
| 2,946,067 | 7/1960 | Wolshin | 5/344 |
| 3,170,172 | 2/1965 | Kessman | 5/344 |
| 3,636,574 | 1/1972 | Kramer | 5/191 |
| 3,813,716 | 6/1974 | Francis | 5/344 |
| 3,983,587 | 10/1976 | Gonan | 5/338 |

*Primary Examiner*—Casmir A. Nunberg

*Attorney, Agent, or Firm*—Norman S. Blodgett; Gerry A. Blodgett

[57] ABSTRACT

Air mattress with upper and lower sheets, the upper sheet being transparent to ultra-violet and the lower sheet being reflective.

10 Claims, 3 Drawing Figures

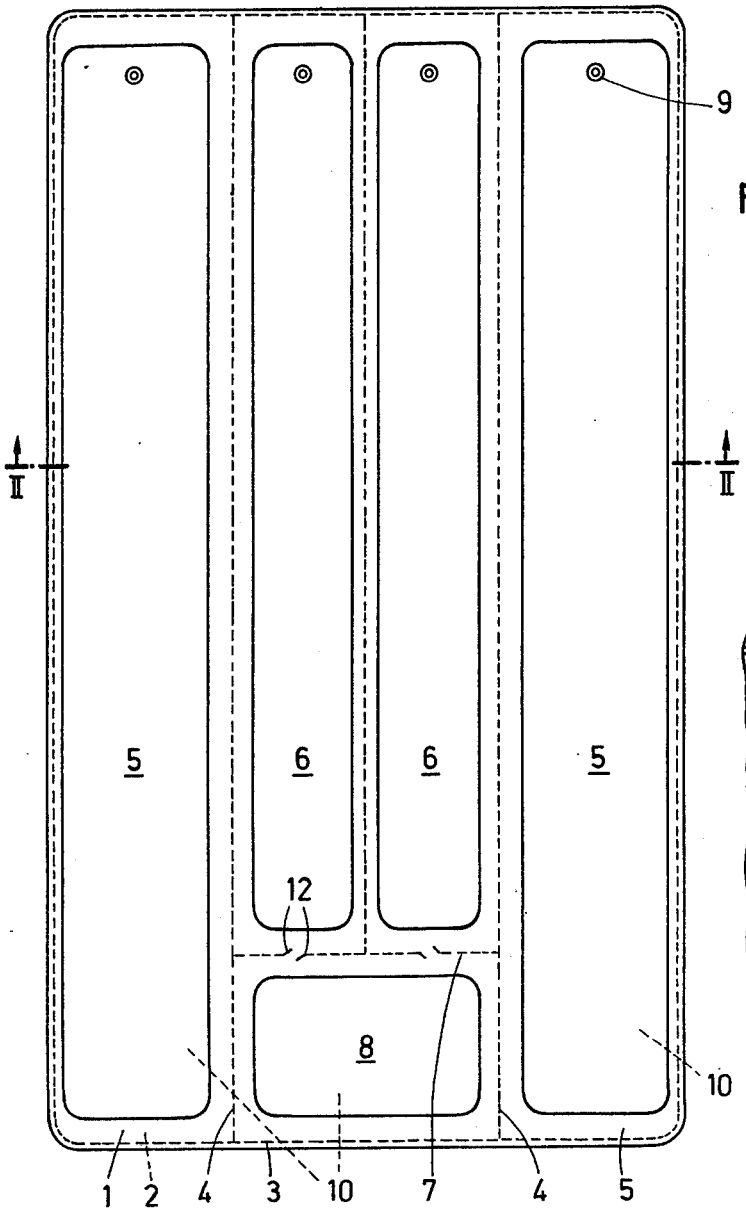
Fig. 1
Fig. 3
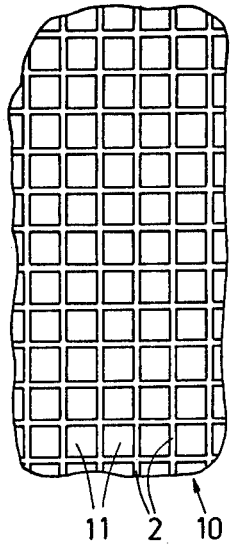
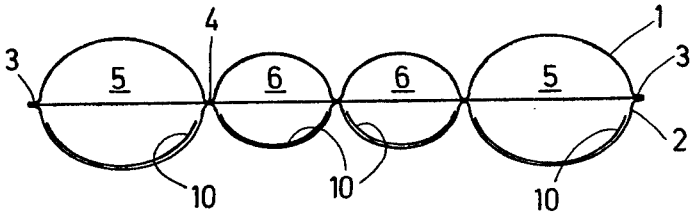
Fig. 2

AIR MATTRESS

BACKGROUND OF THE INVENTION

The invention relates to an air mattress having two superposed PVC sheets, which are continuously interconnected along border strips, as well as interconnected within other strip-like regions for subdivision into air chambers, at least one of the air chambers being equipped with a closable filling hole. Such air mattresses are used in tenting and camping as support for sleeping, as a make-shift bed for overnight stay, or as a soft support for use while sun bathing. The use of PVC sheet as a base material for the fabrication of air mattresses maintains fabrication costs low and reduces the weight as well as the space requirements when in the collapsed state, so that it can be carried along as part of emergency baggage. As a matter that deserves improvement, it it, however, frequently found that, despite the air base, too much heat is dissipated. Also, in sun bathing the body is exposed to light at one side only, so that a uniform tan can only be achieved through repeated changes of position of the body of the sun bather.

It is, therefore, an object of the present invention to reduce the dissipation of heat of air mattresses and to achieve (in the case of sun bathing) a more uniform distribution of light on the body of the sun bather.

SUMMARY OF THE INVENTION

In general, the present invention consists of making at least the upper sheet of a UV-stabilized transparent PVC material and of providing upper side of the lower PVC sheet with metal foil extending over and laminated to the bottom surfaces of the air chambers. Border bulges are provided at a distance corresponding at least to the width of the human body and formed by air chambers. By using reflecting metal foils, the transmission of heat from the upper side to the bottom side of the air mattress is reduced by a reduction of the radiation. Incident light laterally entering the border bulges is deflected and dispersed through the border bulges. Also, by means of the reflecting metal foils provided at the bottom of the border bulges, the light is thrown onto the contact surface of a body that is stretched out of the air mattress, so that the effect of light reaches broad areas of the surface of the body.

The border bulges are beneficially separated from the air chambers arranged between them by means of continuous connections and are equipped with separate filling holes, so that the border bulges can be kept under a different pressure than the air chambers arranged between them. It has proved advantageous to laminate onto the upper surface of the lower PVC sheet aluminum foils as reflecting means. By subdividing the laminated metal foils into elementary areas of small size, it is possible to counteract the tendency of the metal foil to peel because of the different modulus of elasticity of the metal foil and of the PVC sheet that supports them.

It has been found to be worth imitating to form the connections of the upper sheet with the lower sheet through weld seams. Variations of tension in the PVC sheet that supports the metal foil are reduced if its elementary areas are laminated onto the lower PVC sheet at certain intervals. Also, to improve the effect of light, when the sun is low in the sky, the lower PVC sheet can be formed of a transparent PVC material. The adhesion of the laminated metal foil is improved if the upper surface of the lower PVC sheet is frosted.

To facilitate the filing of the air chambers, the filing holes are equipped with check valves. It has been found worthy of imitation to provide longitudinally extending air chambers between the longitudinally extending border bulges, as well as a cushion-like air chamber arranged transverse at one end and to define these air chambers relative to each other by intermittent weld seams. It is expedient to have the free ends of the intermittent weld seams run diagonally of one another in opposite directions. The share of the reflected light can be augmented if the border bulges are made wider than the air chambers that extend longitudinally between them.

BRIEF DESCRIPTION OF THE INVENTION

The character of the invention, however, may be best understood by reference to one of its structural forms, as illustrated by the accompanying drawings, in which:

FIG. 1 is a plan view of an air mattress, embodying the principles of the present invention, FIG. 2 is a sectional view of the air mattress, taken on the line II — II of FIG. 1, and FIG. 3 is an enlarged view of a portion of one of the reflectors shown in FIG. 2.

DESCRIPTION OF THE PREFERRED EMBODIMENT

FIGS. 1 and 2 show an air mattress that essentially consists of two rectangular pieces of a transparent PVC sheet. At least the upper sheet 1 is formed of a UV-stabilized transparent material and the lower sheet 2 is formed of a material whose upwardly-oriented surface is frosted (matted). The upper sheet 1 and the lower sheet 2 are connected with one another by a peripheral uninterrupted weld seam 3. The opposite sides of the weld seam 3 are connected by longitudinally-extending, continuous weld seams 4, which define border bulges 5 from the air mattress. Longitudinally-extending air chambers 6 divide the area between the border bulges by means of additional, subdividing weld seams. A transversely-running, intermittent weld seam 7 defines before the air chambers 6 a cushion-like air chamber 8. The space between the continuous weld seams 4 and, therefore, the width of the area forming the air chambers 6, 8 is adapted to the width of the human body or falls only slightly below it, respectively, so that substantial circumferential regions of the border bulges 5 freely project laterally from under a person lying on the air mattress.

The border bulges 5 and at least one of the air chambers 6 (in the exemplified embodiment both air chambers 6) are provided with filling holes 9 which are equipped with releasable check valves, and which permit the filling of the border bulges and the air chambers with air, as well as the discharge of the air after use.

The upper surface of the lower sheet 2 (which defines the air chambers as well as the downwardly-extending bulges) is laminated with a thin foil of pure aluminum. As is shown in FIG. 3, the metal foils 10 are not, however, applied continuously in a single piece, but are rather formed in a plurality of elementary areas 11 (in the exemplified embodiment they are of square shape), which are dispose with a selected spacing. The application of this metal foil 10 (represented by elementary areas 11) is carried out with the application of heat and pressure, prefably in connection with a synthetic resin glue.

The upper sheet 1 can be selected with a thickness of 0.3 mm and the lower sheet with a thickness of 0.4 mm, while the aluminum layer is considerably thinner. The lower thicknesses, along with the high flexibility, result in a desirable low weight, as well as a minimal space requirement for the air mattress when emptied and folded.

The metal foils 10 laminated onto the upper surface of the lower sheet 2 act as reflectors and entail in use two different effects. The person lying on the air mattress gives off heat to it. To keep the body warm, one will wish to limit this withdrawal of heat as much as possible. Small amounts only of heat are given off by heat conductance within the foil, since the heat conductance of the plastics material is relatively small and the minimal thickness of the foil permits it to carry only a small heat flow. Also, the heat loss through convection within the air layer that supports the upper sheet is relatively small. The radiation share of the usual heat emission is maintained at a low value in the present case by means of metal foil 10; it extends under the supported body and throws back by reflection the heat radiation that issues from it.

When the air mattress is used for air or sun bathing, then light or sun radiation, respectively, can enter into the border bulges 5 which project beyond the supported body. The UV-stabilized transparent material that is used as upper sheet 1 permits practically unhindered entry to the incident radiation, so that it falls onto the associated reflector foil 10 and is reflected from this to the underside of the body resting on the air mattress. The curvature of the lower sheet 2 (and thus of the associated metal foil 10 resulting from the inflating of the border bulges 5) yields, in connection with the division of the metal foil into elementary areas 11, an adequate dispersion to cause an approximately uniform exposure of the underside of the body and thereby a correspondingly uniform tan of the body. The deflection of incident light radiation caused by the reflector can be influenced throught variably strong inflation of the border bulges 5 that are to be filled via separate valves. It is beneficial that the light conveyed to the body via the border bulges passes twice through the upper sheet 1, so that this can exercise a certain filtering effect. While the visible light as well as the heat radiation can pass through the transparent sheet, the short-wave UV-shares of the radiation of the sun are damped in a suitable manner, so that the usually desirable tan coloring is assured, but that the risk of skin irritation or burning is reduced. The described properties make the air mattress constructed according to the invention recommendable for tenting and camping in cool weather (where the reduction of heat losses is desirable), as well as for air or sun bathing, where (on the one hand) and intensive light effect is desired, but (on the other hand) a uniform light effect is also desired. The handling of the air mattress is relatively simple, since the border bulges 5 can be inflated for adaptation to the specific light conditions, while the air chambers 6 and 8 that support the weight of the body are separated by intermitted weld seams 7, so that joint filling is possible. As shown in FIG. 1, the interruptions are only provided in the transverse seam 7. By use of oppositely-directed diagonal forming of the free ends of the intermittent weld seam and corresponding distance of the opposite regions of the free ends, e.g. 30 mm, equalization of pressure differences of the air flow is achieved. An adequate cross-sectional area is available for air passage to permit a silent passing of the air and, because of the swirl arising when the air flows through, the risk is eliminated that the upper sheet 1 might stick to the lower sheet 2.

The air mattress constructed in accordance with the invention is distinguished on tenting and camping in cool weather by its far-reaching elimination of radiation losses through low heat losses while in air or sun bathing the body can practically be exposed in intensive light on all sides. The air mattress can be placed directly on the ground. It is also possible to lay it on folding chairs and the like; particularly in the latter case, it is recommended that the free ends of the air mattress be equipped with inwardly-opening caps or in the end region with transverse strap-like foil extensions, so that the ends of the folding chairs can be pushed into the loops formed by the straps and so that a connection can be established that secures the position of the air mattress.

It is obvious that minor changes may be made in the form and construction of the invention without deparating from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Air mattress comprising:

(a) an upper sheet formed of a polymer plastic which is transparent to ultra-violet light, (b) a lower sheet formed of air-tight material, and (c) a layer of ultra-violet light reflective material on the upper surface of the lower sheet divided into a grid-like pattern comprising a plurality of individual reflective areas divided by non-reflective areas, the two sheets being sealed together to form a plurality of air-tight pockets in which substantial portions of the sheets are held in spaced relationship so that a person lying on the upper sheet not only receives ultra-violet light directly on his upwardly-directed surface, but also receives ultra-violet light indirectly on his downwardly-surface, at least one of the pockets being provided with a closable filling hole.

2. Air mattress as recited in claim 1, wherein the layer of ultra-violet reflective material is metal foil laminated onto the upper surface of the lower sheet.

3. Air mattress as recited in claim 1, wherein the sides of the mattress are provided with pockets which extend beyond the normal width of a human body to form border bulges.

4. Air mattress as recited in claim 1, wherein the pockets forming the border bulges are separated from interior pockets and are equipped with separate filling holes.

5. Air mattress as recited in claim 4, wherein the filling holes are provided with check valves.

6. Air mattress as recited in claim 1, wherein the upper end and lower sheets are connected through weld seams.

7. Air mattress as recited in claim 1, wherein the upper side of the lower sheet is provided with a frosted surface to enhance adherance of the reflective material.

8. Air mattress as recited in claim 1, wherein the pockets extend longitudinally of the mattress and the mattress comprises a cushion-like air chamber disposed transversely at one end.

9. Air mattress as recited in claim 8, wherein the cushion-like air chamber is separated from the pockets by an intermittent weld seam which allows air to pass freely between the chamber and pockets.

10. Air mattress as recited in claim 9, wherein adjacent free ends of the weld seams extend from the seams at diverging angles.

* * * * *